US005240059A

United States Patent [19]

White

[11] Patent Number: 5,240,059

[45] Date of Patent: Aug. 31, 1993

[54] CURTAIN TIE MEMBER AND METHOD

[76] Inventor: Rosalee White, 815 "C" St. #21, Marysville, Calif. 95901

[21] Appl. No.: 783,195

[22] Filed: Oct. 28, 1991

[51] Int. Cl.[5] ..... A47H 19/00

[52] U.S. Cl. ..... 160/349.2; D6/578

[58] Field of Search ..... 160/349.1, 349.2; 248/205.2; D6/578, 580

[56] References Cited

U.S. PATENT DOCUMENTS

| | | | |
|---|---|---|---|
| D. 101,224 | 9/1936 | Kirsch . | |
| D. 109,600 | 5/1938 | Baird . | |
| D. 125,963 | 9/1940 | Cohen . | |
| D. 166,108 | 3/1952 | Vance | D6/578 |
| D. 167,492 | 8/1952 | Zakarin . | |
| 562,966 | 6/1896 | Michelfelder | 160/349.2 |
| 1,057,491 | 4/1913 | Morrison et al. . | |
| 1,237,224 | 8/1917 | Schultz | 160/349.2 X |
| 2,190,764 | 2/1940 | Arnold | 160/349.2 |
| 2,247,253 | 6/1941 | Rosenberg | 160/349.2 |
| 2,391,205 | 12/1945 | Van Cleeff | 160/349.2 |
| 2,563,306 | 8/1951 | Burrage | 160/349.2 |
| 2,796,925 | 6/1957 | Woodward | 160/349.2 X |
| 4,759,963 | 7/1988 | Uso, Jr. et al. | 248/205.2 X |
| 4,878,585 | 11/1989 | Orestano | 248/205.2 X |
| 4,930,562 | 6/1990 | Goodman . | |

FOREIGN PATENT DOCUMENTS

| | | | |
|---|---|---|---|
| 18655 | of 1889 | United Kingdom | 160/349.2 |
| 27958 | of 1903 | United Kingdom | 160/349.2 |

*Primary Examiner*—David A. Scherbel
*Assistant Examiner*—Derek J. Berger
*Attorney, Agent, or Firm*—Oltman and Flynn

[57] ABSTRACT

A tie member for wrapping around a gathered section of curtain suspended from a curtain rod includes a loop for placing around the curtain rod and either one or two flexible leg portions extending from the loop. The tie member optionally includes patches of hook-and-loop fastener material on the flexible leg portions positioned to mesh together when the flexible leg portions are wrapped around the gathered sections. A method for wrapping a single flexible leg portion of a single tie member around a gathered section, the section having an outer edge, includes the steps of wrapping the flexible leg portion over the front of the gathered section away from the outer edge, wrapping the flexible leg portion around the back of the gathered section and fastening the flexible leg portion to itself. A method for wrapping the flexible leg portions of two single leg tie members around a gathered section, includes the steps of wrapping each flexible leg portion across the back of the gathered section, wrapping each flexible leg portion around the front of the gathered section and fastening the flexible leg portions together. A method for wrapping the flexible leg portions of a single two leg tie member around the gathered section is also provided.

7 Claims, 4 Drawing Sheets

CURTAIN TIE MEMBER AND METHOD

BACKGROUND OF THE INVENTION

1. Field of the Invention

The present invention relates generally to the field of curtains suspended from a curtain rod, and more specifically to a tie member having a loop encircling the curtain rod and a flexible leg portion extending from the loop for wrapping around and securing a section of the curtain, when the section is gathered to one side in an open position.

2. Description of the Prior Art

A handful of devices are found in the prior art for securing gathered curtain sections. Such devices include that of Cohen, U.S. Des. Pat. No. 125,963, issued on Mar. 18, 1941. Cohen teaches a curtain section having a tie strap, one end of which is attached to the outer edge of the section and the remainder is wrapped around the gathered section. A problem with the Cohen tie strap is that it is apparently stitched to the curtain fabric which thus must carry the load. This can lead to sagging and eventual tearing of the stitched area. Apart from strength considerations, the location of the tie strap midway down the curtain section limits the variations with which it can be wrapped around the section. Also, should a change in appearance be desired, the straps cannot be readily changed.

A similar tie strap arrangement is disclosed in Baird, U.S. Des. Pat. No. 109,600, issued on May 10, 1938. The strap is apparently attached to the outer edge of the curtain section as in Cohen, and thus shares the same disadvantages. Alternatively, the Baird strap may be simply wrapped around the section and joined to itself to form a ring member. A problem with such a ring member is that it might become disengaged and slide down the section.

Kirsch, U.S. Des. Pat. No. 101,224, issued on Sep. 15, 1936, teaches a series of vertically suspended ropes. A hook extends from the end of the curtain rod and holds the ropes up and to one side. A problem with the Kirsch hook is that it is not flexible and thus cannot wrap around the curtain section in an aesthetically pleasing manner. Also, if the hook were long enough to reach the middle of a typical curtain section, it would be essentially vertical. A rigid, vertical hook could not effectively gather and hold the curtain section.

Other curtain related arrangements are found in the prior art which have no tying provisions. An example is Gotsch, U.S. Pat. No. 1,057,491, issued on Apr. 1, 1913. Gotsch teaches a series of vertically suspended bead chains which function in the manner of a curtain, providing an attractive border around a door or window. Another is Zakarin, U.S. Des. Pat. No. 167,492, issued on Aug. 12, 1952, for a particular valance pattern. Finally, there is Goodman, U.S. Pat. No. 4,930,562, issued on Jun. 5, 1990, which discloses a decorative structure for covering valances and blind slats. None of these references teaches means for pulling or holding curtain sections in gathered bundles.

It is thus an object of the present invention to provide a tying apparatus which is strong and reliable, and will permit the curtain rod to carry the load.

It is another object of the present invention to provide such an apparatus which can be readily replaced, such as to provide a new color scheme.

It is finally an object of the present invention to provide such an apparatus which is inexpensive and easy to use.

SUMMARY OF THE INVENTION

The present invention accomplishes the above-stated objectives, as well as others, as may be determined by a fair reading and interpretation of the entire specification.

A tie member is provided for wrapping around a gathered section of curtain suspended from a curtain rod, and includes a loop for placing around the curtain rod and either one or two flexible leg portions extending from the loop. The tie member optionally includes hook-and-loop fasteners on the flexible leg portions positioned to mesh together when the flexible leg portions are wrapped around the gathered sections.

A method is also provided for wrapping a single flexible leg portion of a single tie member around a gathered section, the section having an outer edge, including the steps of wrapping the flexible leg portion over the front of the gathered section away from the outer edge, wrapping the flexible leg portion around the back of the gathered section, and fastening the flexible leg portion to itself. A method is provided for wrapping the flexible leg portions of two single leg tie members around a gathered section, including the steps of wrapping each flexible leg portion across the back of the gathered section, wrapping each flexible leg portion around the front of the gathered section and fastening the flexible leg portions together. A method is also provided for wrapping the flexible leg portions of a single two leg tie member around the gathered section, including the steps of wrapping one leg member diagonally across the upper part of the gathered section in front of the gathered section, wrapping the upper part of the other leg member diagonally across the upper rear face of the gathered section, passing the first leg member around to the back of gathered section and passing second leg member around to the front of gathered section and causing both the first and second leg members to extend almost horizontally across the gathered section, and fastening the first and second leg members together.

BRIEF DESCRIPTION OF THE DRAWINGS

Various other objects, advantages, and features of the invention will become apparent to those skilled in the art from the following discussion taken in conjunction with the following drawings, in which.

DETAILED DESCRIPTION OF THE PREFERRED EMBODIMENTS

Figure 1:
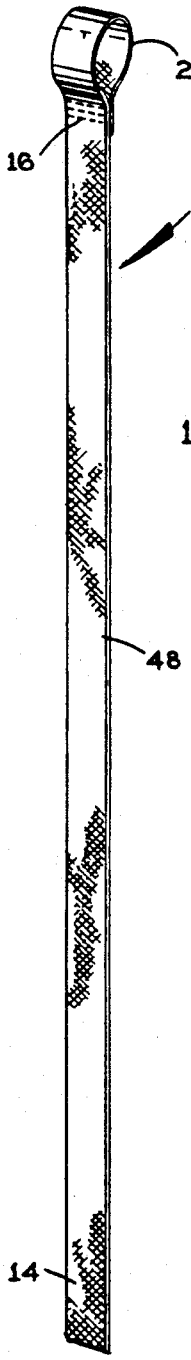
FIG. 1 is a perspective view of the first preferred embodiment of the inventive curtain tie member having a single leg portion.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Referring to FIG. 1, the first preferred embodiment of an inventive curtain tie member 10 is disclosed. Member 10 is a length of flexible material having an upper end 12 and a lower end 14. Upper end 12 is doubled over and secured to member 10 to form a loop 20. Securing is preferably accomplished with stitches 16.

Curtains 30 are normally divided into two vertical sections 32 which are slidably secured at their upper edges 34 to a curtain rod 40. The position of the outer vertical edges 42 of curtain sections 32 remain essentially fixed while the inner vertical edges 44 can be slid together or apart. When pulled apart, each vertical section 32 gathers in accordion fashion at an end of curtain rod 40. Members 10 serve to removably hold sections 32 in a tightly gathered configuration.

Figure 2:
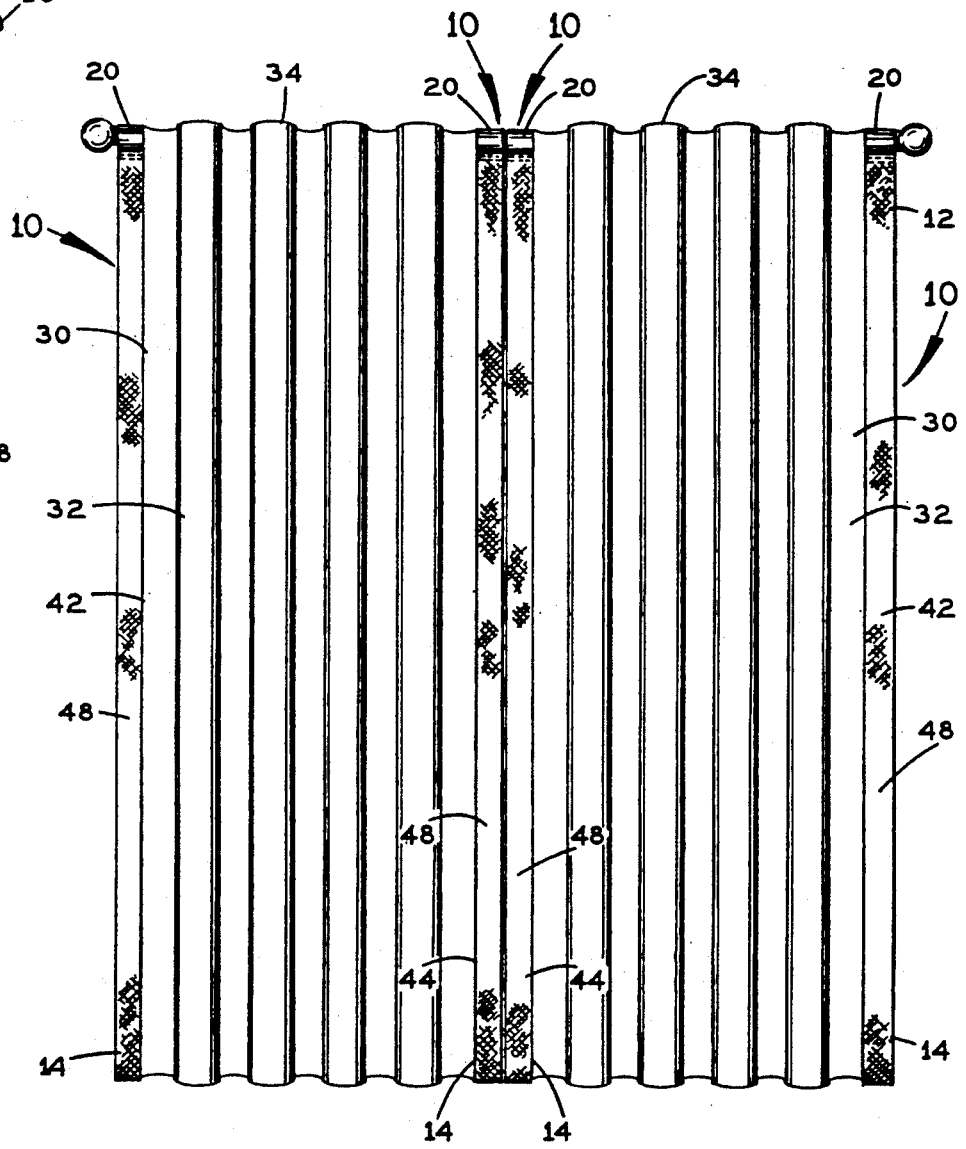
FIG. 2 is a front view of a curtain in the closed position having a curtain tie member of the first preferred embodiment on either side of each curtain section.
Figure 3:
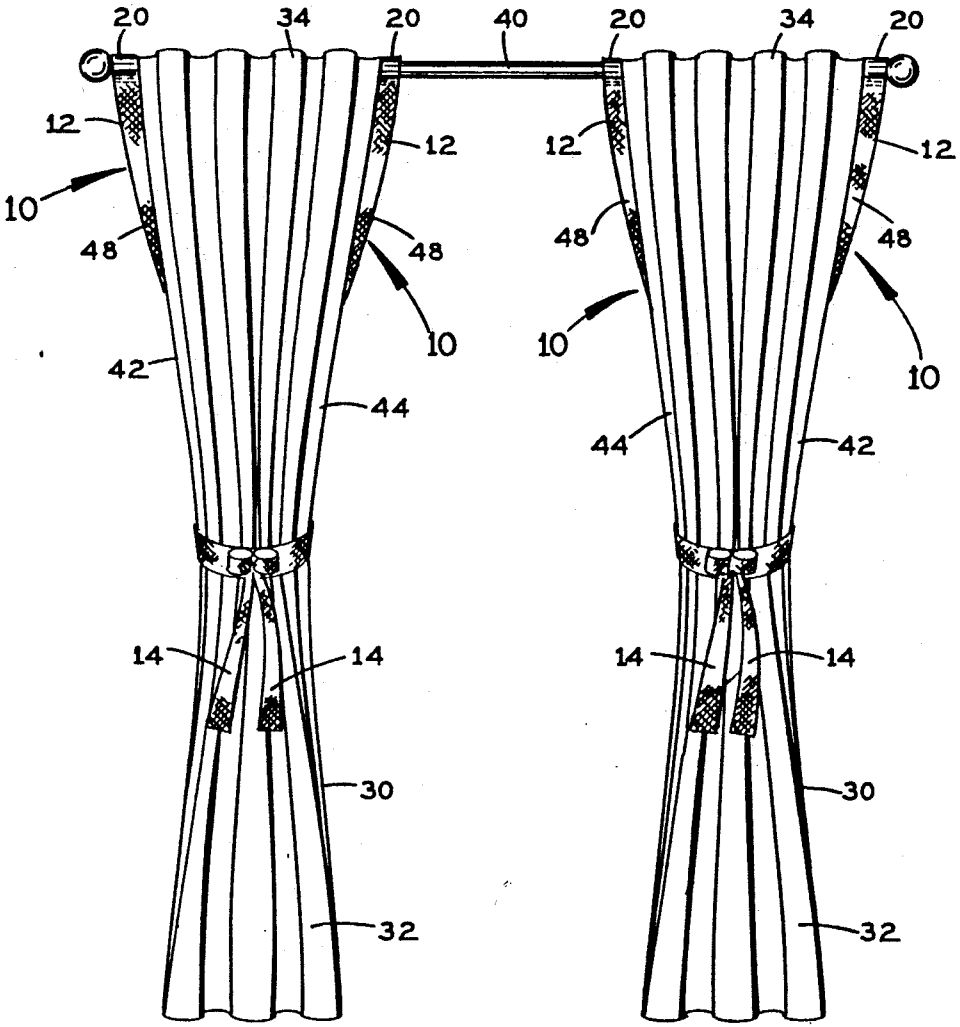
FIG. 3 is a front view of the curtain of FIG. 2 in the open position secured by the curtain tie members.

Loop 20 encircles curtain rod 40 such that the remaining part, or leg 48, of member 10 hangs down vertically beside a curtain section 32 when not fastened. A member 10 is placed on either side of each curtain section 32, as shown in FIG. 2. Legs 48 of members 10 are wrapped around their adjacent curtain section 32 according to the method described below, and fastened to each other. Fastening may be accomplished by tying lower ends 14 of members 10 together. See FIG. 3. Lower ends 14 may also be fitted with patches of hook-and-loop fastener material such as VELCRO TM, and then pressed against each other. The term "fastening" as used in the claims includes both tying and joining with hook-and-loop fasteners, or otherwise connecting the legs. It is preferred that loop 20 be no more than a few inches in diameter and that the length of member 10 be equal to or greater than the vertical length of curtain sections 32 to be secured.

Figure 4:
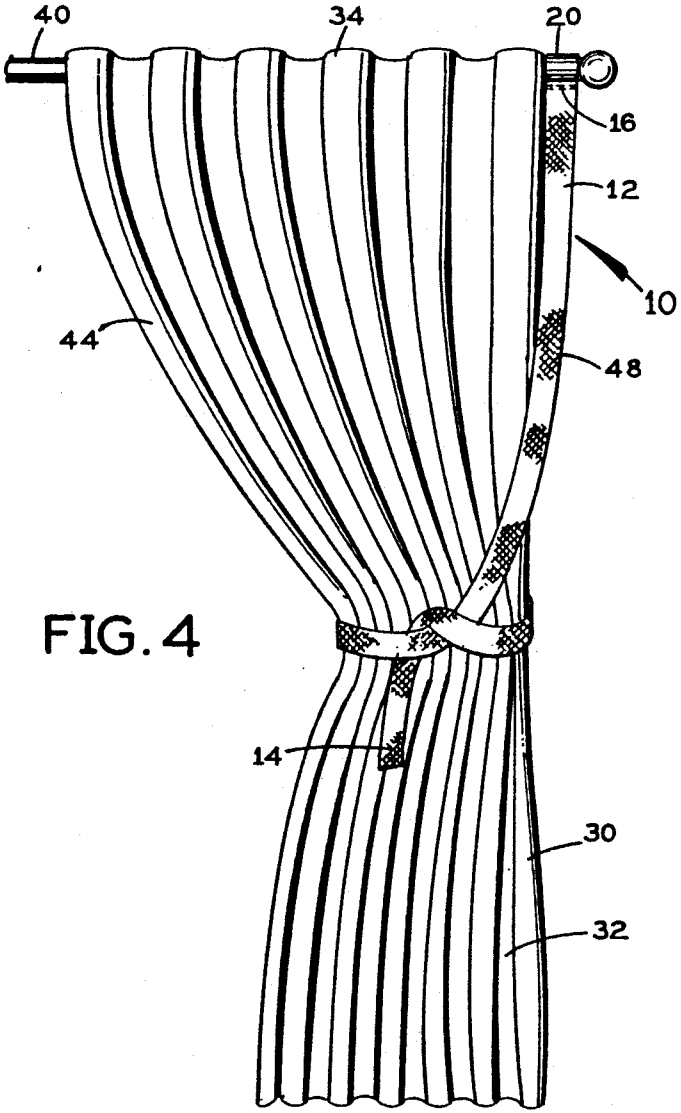
FIG. 4 is a front view of a curtain in the open position secured by a single curtain tie member of the first preferred embodiment.

Alternatively, only one member 10 is provided adjacent to outer edge 42 of each curtain segment 32. Its leg 48 is wrapped around the gathered segment 32 and tied or fastened to itself with a hook-and-loop fastener material. See FIG. 4.

Second Preferred Embodiment

Figure 6:
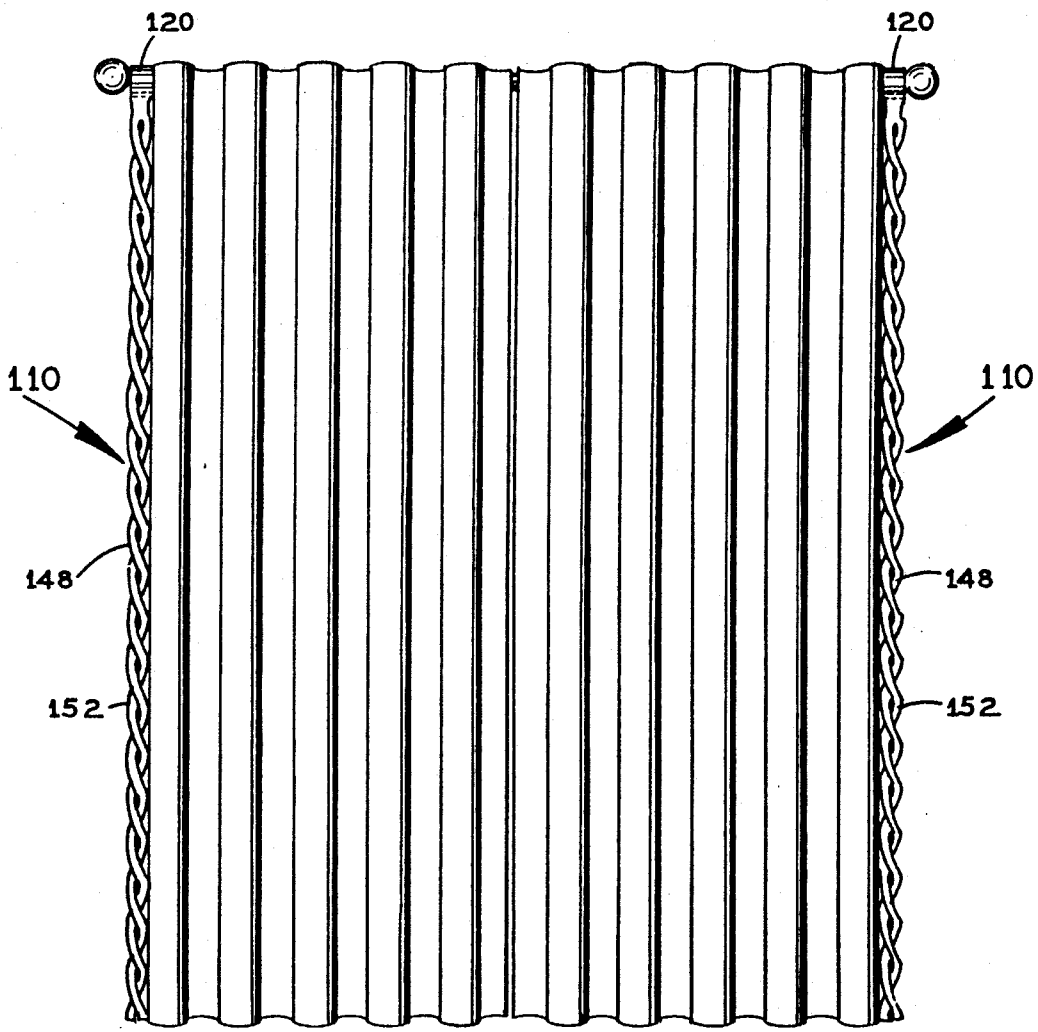
FIG. 6 is a front view of a curtain in the closed position having a braided curtain tie member of the second preferred embodiment at the outer edge of each curtain section.
Figure 5:
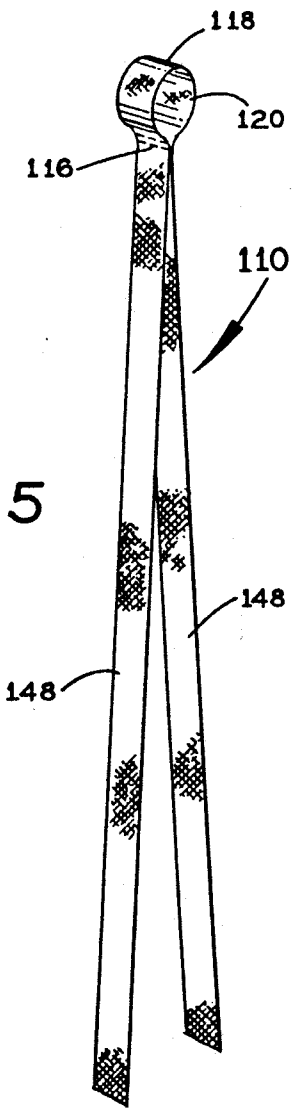
FIG. 5 is a perspective view of the second preferred embodiment of the inventive curtain tie member having two leg portions.
Figure 7:
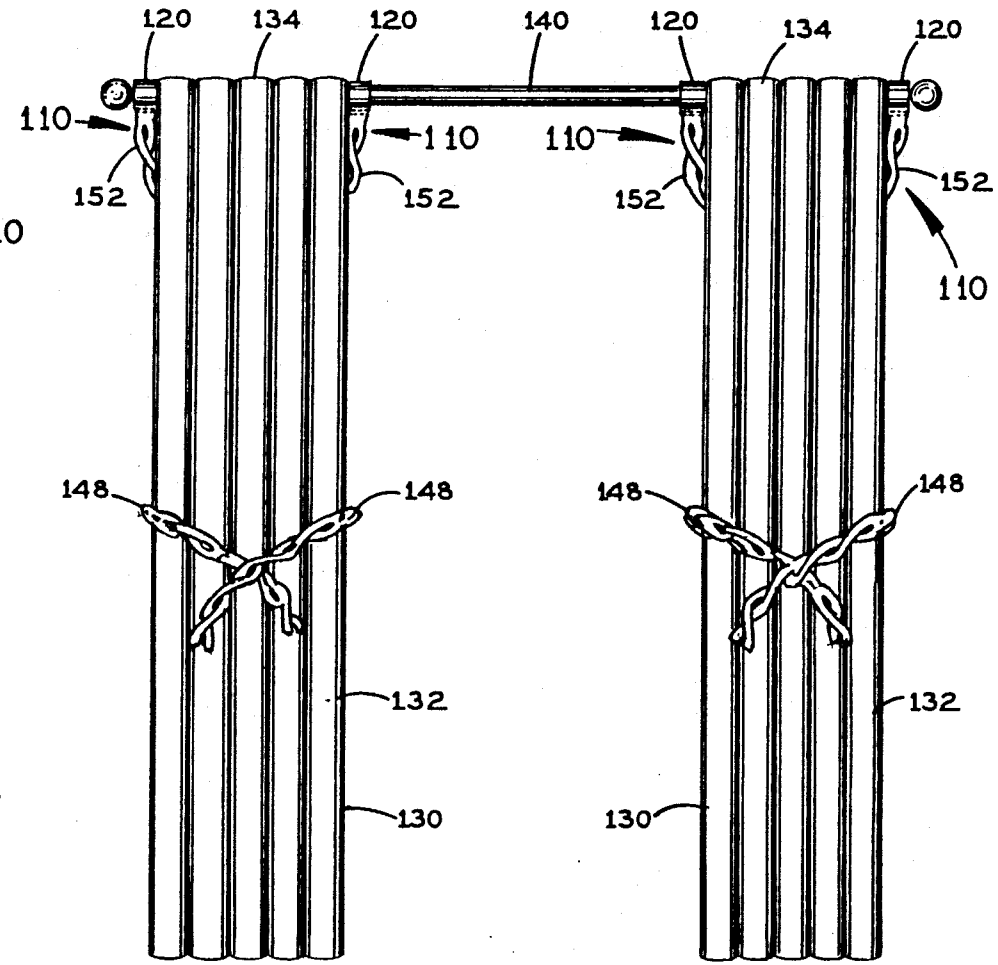
FIG. 7 is a front view of the curtain of FIG. 6 in the open position secured by the braided curtain tie members.

The second preferred embodiment is like the first except that member 110 is folded over itself in its middle area and stitches 116 are provided a few inches from the fold 118 to form loop 120. The result is that two legs 148 extend from loop 120. See FIG. 5. The two legs 148 can be wrapped around each other to form a braid-like configuration as shown in FIG. 6. Then each braided length 152 can be fastened around a gathered section 132 according to the method set forth below for single leg 48 members 10. See FIG. 7.

Figure 8:
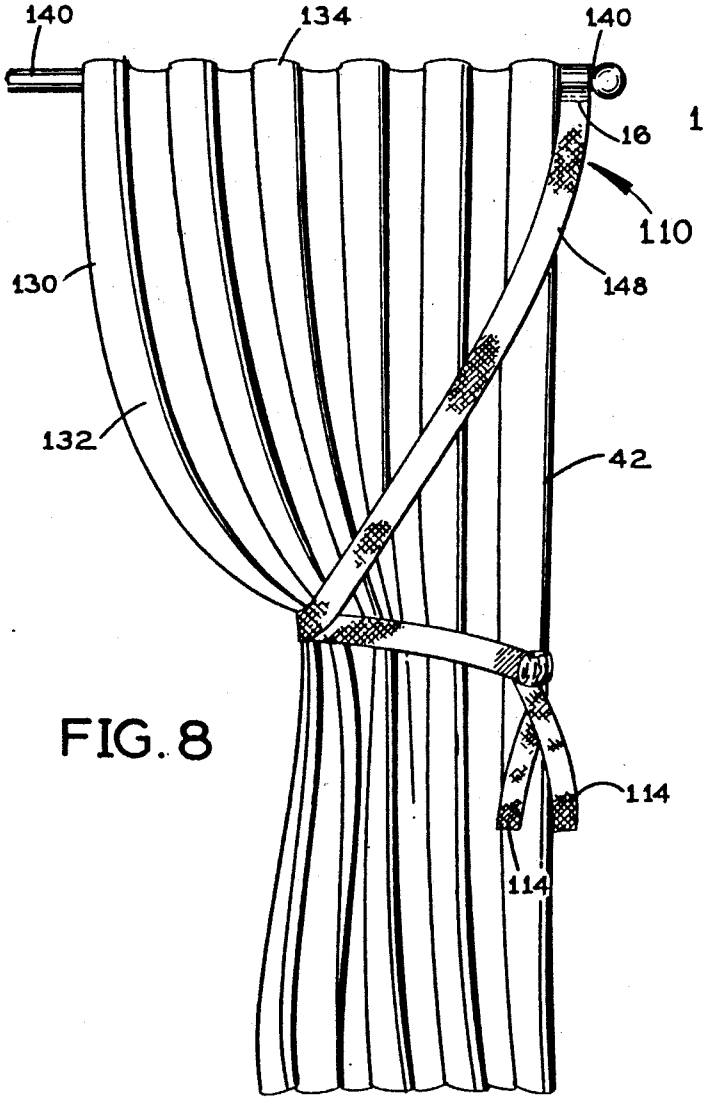
FIG. 8 is a front view of a curtain in the open position secured by a single curtain tie member of the second preferred embodiment.

This double leg 148 embodiment can be particularly beneficial where only one member 110 is provided for each curtain section 132. Legs 148 can be wrapped around section 132 and joined together in the manner described below. See FIG. 8.

Members 10 and 110 may be formed of a fabric which matches or which aesthetically contrasts with curtain 30 fabric. Also, for a more bohemian look, members 10 may be formed of rope or macrame. Still another alternative is that members 10 and 110 be formed of chain, made of either plastic or a nonrusting metal such as brass or aluminum. Finally, it is to be understood that a loop 20 or 120 is contemplated which has more than two legs 48 or 148.

Method

In practicing the invention, the following method may be used. For the single leg 48 embodiment provided on only one side of a curtain section 32, leg 48 hangs vertically next to curtain 30 when it is untied. Leg 48 may be arranged as in FIG. 4 by wrapping leg 48 around the front of gathered section 32 away from outer edge 42. Then it is fastened to itself adjacent to outer edge 42.

For the single leg 48 embodiment provided on both sides of a curtain section 32, each leg 48 is preferably first wrapped around the back of curtain section 32. Then each leg 48 is brought around to the front of section 32 and fastened to the other leg 48. See FIG. 3. Legs 48 are preferably long enough to dangle from the fastening point.

For the double leg 148 embodiment provided on one side of a curtain section 132, both legs 148 hang vertically next to curtain 130 when they are untied. Legs 148 may be arranged as in FIG. 8 by wrapping front leg 148 diagonally across the upper part of curtain 130 in front of curtain 130 and wrapping the upper part of rear leg 148 diagonally across the upper rear face of curtain 130. Front leg 148 is then passed around to the back of curtain 130 and rear leg 148 is passed around to the front of curtain 130 and both of these legs 148 extend almost horizontally across curtain 130 to the outside, where ends 114 are tied or fastened together with a hook-and-loop fastener material.

It is to be understood that these wrapping and tying methods are merely preferred and that many others are contemplated.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A curtain tie apparatus wrapped around a gathered section of a curtain, comprising:

a curtain rod for attachment to a wall to support said curtain, a flexible loop placed around said curtain rod, a flexible leg extending from said loop wrapped around said gathered section, said loop and said leg being integral portions of a one piece entirely flexible curtain tie member.

2. A curtain tie apparatus as in claim 1, additionally comprising:

hook-and-loop fasteners on the flexible leg portion positioned to mesh together when the flexible leg portion is wrapped around the gathered section.

3. A curtain tie apparatus wrapped around a section of a curtain, comprising;

a curtain rod for attachment to a wall to support said curtain, a flexible loop placed around said curtain rod, two flexible legs extending from said loop wrapped around said gathered section, said loop and legs being integral portions of a one piece entirely flexible curtain tie member.

4. A curtain tie apparatus as in claim 3, additionally comprising:

hook-and-loop fasteners on each of the two flexible leg portions, positioned to mesh together when the flexible leg portions are wrapped around the gathered section.

5. A method of operating a curtain tie apparatus comprising a curtain having a gathered section and an edge, a curtain rod for attachment to a wall to support said curtain, a loop for placing around said curtain rod, and a flexible leg portion extending from said loop, comprising the steps of:

wrapping the flexible leg portion over the front of the gathered section away from the outer edge, wrapping the flexible leg portion around the back of the gathered section, fastening said flexible leg portion to itself adjacent to the outer edge.

6. A method of operating a curtain tie apparatus comprising a curtain having a gathered section, a curtain rod for attachment to a wall to support said curtain, a loop for placing around said curtain rod, and two flexible leg portions extending from said loop, comprising the steps of:

wrapping each flexible leg portion across the back of the gathered section, wrapping each flexible leg portion around the front of the gathered section, fastening the flexible leg portions together.

7. A method of operating a curtain tie apparatus comprising a curtain having a gathered section, a curtain rod for attachment to a wall to support said curtain, a loop for placing around the curtain rod, first and second flexible leg portions extending from said loop, comprising the steps of:

wrapping one leg member diagonally across the upper part of the gathered section in front of the gathered section, wrapping the upper part of the other leg member diagonally across the upper rear face of the gathered section, passing the first leg member around to the back of gathered section and passing second leg member around to the front of gathered section and causing both the first and second leg members to extend almost horizontally across the gathered section, fastening the first and second leg members together.

* * * * *